United States Patent [19]

Oshima et al.

[11] Patent Number: 4,490,435

[45] Date of Patent: Dec. 25, 1984

[54] THERMAL DYE-TRANSFER TYPE RECORDING SHEET

[75] Inventors: Hiroyo Oshima; Isao Kano; Yutaka Kojima; Ken Ishiguro; Koichi Nagai; Kunio Hata, all of Tokyo, Japan

[73] Assignee: Jujo Paper Co., Ltd., Tokyo, Japan

[21] Appl. No.: 493,365

[22] Filed: May 10, 1983

[30] Foreign Application Priority Data

Jun. 1, 1982 [JP] Japan ..... 57-92136

[51] Int. Cl.[3] ..... B41M 5/26

[52] U.S. Cl. ..... 428/341; 8/471; 428/206; 428/207; 428/211; 428/328; 428/330; 428/331; 428/342; 428/524; 428/530; 428/913; 428/914

[58] Field of Search ..... 8/471; 428/206, 207, 428/211, 327, 511, 524, 530, 537, 913, 914, 328–331, 340–342, 537.5

[56] References Cited

U.S. PATENT DOCUMENTS 4,406,662 9/1983 Beran et al. ..... 8/471

FOREIGN PATENT DOCUMENTS 48-11409 4/1973 Japan ..... 8/471

*Primary Examiner*—Bruce H. Hess

*Attorney, Agent, or Firm*—Koda and Androlia

[57] ABSTRACT

A recording sheet for thermal dye-transfer type recording having a coating layer which is placed on a substrate, which is contacted with a coloring material layer containing sublimable dye and on which the sublimable dye is transferred by heating, wherein the coating layer includes an aminoalkyd resin, whereby the recording sheet provides a record with superior color density and causes no heat-adhesion between the recording sheet and a thermal transfer substrate.

3 Claims, No Drawings

THERMAL DYE-TRANSFER TYPE RECORDING SHEET

BACKGROUND OF THE INVENTION

1. Field of the Invention

The present invention relates to a thermal-dye transfer type recording sheet, and more particularly to a recording sheet for thermal dye-transfer type recording method, in which a coloring material layer containing sublimable dye is provided on a base sheet, the coloring material layer is brought into contact with a recording sheet and the dye is transferred to the recording sheet by heating with a thermal head or the like.

2. Prior Art

In the thermal recording method there is widely adopted a method in which a heat-sensitive paper having thereon a recording layer to be colored under heating by a physical or chemical change is brought into contact with a thermal head and then a record of a desirable color is obtained on the heat-sensitive recording paper. The heat-sensitive recording method, however, is defective in that coloration or contamination is readily caused in a heat-sensitive recording paper because of pressure or heat unavoidably applied to the heat-sensitive recording paper during storage or during handling. Furthermore, it is defective in that a highly revolved multichromatic recording is difficult to achieve technically.

As means for overcoming the above defects of the conventional heat-sensitive recording method, there has been proposed a method as disclosed in the Japanese Patent Application Laid-Open Specification No. 15446/76. It discloses a substrate, such as paper or resin film, coated with a coloring material which is solid or semi-solid at room temperatures, the coloring material coated on the substrate is brought into contact with a recording sheet and the coloring material on the substrate is selectively transferred to the recording sheet by heating by a thermal head to perform recording.

As such recording method, there can be used a wet system and the dry system. The wet system includes melting and softening the binder in the coloring material layer and adhereing and transfering binder with the dye to the recording sheet, in thermal transfer recording. In the dry system, sublimable dye is used in the coloring material layer, and the adsorption on the recording sheet is carried out by sublimating the dye.

As coloring material layer in the dry system, there is used the substance which is prepared by kneading a binder and sublimable dye having a sublimation temperature of 60° to 300° C.

Such sublimable dye having a sublimation temperature of 60° to 300° C. are, for example, disperse dyes of the nitro, azo, quinoline and anthraquinone types. The transfer of the dye to the recording sheet does not occur at usual temperature even when the coloring material layer is brought into contact with the recording sheet, but transfer of the dye occurs, first when the coloring material layer is heated to 60°-500° C. and then the dye is sublimated. In each case, conventional plain paper can fundamentally be used.

In contrast to the wet system in which the color material layer itself is transferred, the dry system has a feature that the clearness and color density of the recording image depend on the degree of the adsorption or fixation of sublimable dye to the recording sheet surface. Accordingly, when the conventional plain paper is used in the dry system in which a sublimable dye having poor affinity to fiber is applied, excellent color density cannot be obtained.

SUMMARY OF THE INVENTION

An object of the present invention is to provide a thermal dye-transfer type recording sheet having a record with superior color density. An another object of the present invention is to provide a thermal dye-transfer type recording sheet causing no heat-adhesion between the recording sheet and a thermal transfer substrate even when exposed to a remarkably high heat energy upon high speed thermal transfer.

The above objects are obtained by using the coating layer comprising at least an aminoalkyd resin on the base sheet of the thermal dye-transfer type recording sheet.

DETAILED DESCRIPTION OF THE INVENTION

The aminoalkyd resin for use in the present invention comprises mixing an amino resin and an alkyd resin in, the mixing ratio of between 40:60 to 60:40 (parts by weight).

The amino resin is prepared as follows. For instance, a compound or a mixture of compounds containing amino groups in the molecule such as melamine, urea and guanamine is reacted with formaldehyde and n-butanol in an acidic pH range at a refluxing temperature in a reactor and continuing the reaction while removing resulted water through azeotropic distillation with butanol. Or melamine, urea, guanamine or a mixture of them is methylolated with formaldehyde in an alkaline pH range, is treated with excess butanol, is rendered the pH acidic by adding oxalic acid or the like and is etherificated at a refluxing temperature. The above reaction or etherification is proceeded until the reaction solution dissolves into toluene or mineral spirit and the like, and excess butanol was removed through distillation after the end of the reaction till the resin solution of an appropriate density is obtained.

The alkyd resin is generally prepared by a fatty acid process from fatty acid, phthalic anhydride, glycerin, pentaerythritol and the like as the starting material or by an ester exchanging process from oils an fats, glycerin, phthalic anhydride or the like as the starting material.

The thermal dye-transfer type recording sheet according to the present invention is manufactured by coating the aminoalkyd resin as mentioned above incorporated with a catalyst such as p-toluene sulfonic acid onto a desired support such as common paper, e.g., of fine paper, coating paper, paper board, woven fabric, non-woven fabric and synthetic resin film by using a coating machine such as a reverse roll coater, bar coater and gravure coater and then applying a heat treatment at a high temperature of 120°-150° C. for a short time to harden the same.

The amount of the coating is preferably about 4–15 $g/m^2$.

Furthermore, appropriate pigments such as natural ground calcium carbonate, precipitated calcium carbonate, kaolin, silica, talc, titanium dioxide, aluminum hydroxide, magnesium carbonate, barium sulfate and zinc oxide may be added in the coating layer containing the aminoalkyd resin, if improvement in the whiteness of the paper surface and the natural properties of paper is required.

The thermal dye transfer-type recording sheet obtained according to the present invention, when exposed to heat energy for a short time under the state in contact with the coloring material layer of a thermal transfer substrate, provides high density recording by the instant transfer of subliming dyes in the coloring material layer to the recording sheet. Furthermore, it is stable to remarkably high heat energy caused by the increase in the recording speed and produces no heat-adhesion between the recording sheet and the thermal transfer substrate.

This invention will now be described more specifically referring to examples.

EXAMPLE

To each 94 parts by weight (solid content) of an aminoalkyd resin prepared from an alkyd resin (Hariphthal SB-7540, 59.5% of non-volatiles, manufactured by Harima Chemicals, Inc.) and a melamine resin (Bansemine SM-945, 61% of non-volatiles, manufactured by the same company) blended in the ratio of 75:25, 50:50 and 25:75, as well as of another aminoalkyd resin prepared from an alkyd resin (Arakyd 2302-60, 60% of non-volatiles, manufactured by Arakawa Chemical Industries, Limited) and a urea-melamine resin (Bansemine 1100, 56.3% of non-volatiles, manufactured by Harima Chemicals, Inc.) or benzoguanamine resin (Bansemine SM-940, 57.8% of non-volatiles, manufactured by Harima Chemicals, Inc.) blended each in equal amount, was added respectively an appropriate amount of toluene and further 6 parts by weight of p-toluene sulfonic acid as the catalyst, to prepare coatings No. 1–No. 5.

For the comparison, coatings No. 6 and 7 each composed singly of an alkyd resing (Hariphthal 732, 60.2% of non-volatiles, manufactured by Harima Chemicals, Inc.), as well as of melamine resin (Bansemine SM-975, manufactured by Harima Chemicals, Inc.) were prepared respectively in the same manner as above. Furthermore, 5–30% aqueous solutions or aqueous dispersions of No. 8–No. 11 each composed of methylol melamine for paper processing (Uramin P-6100, manufactured by Mitsui Toazu), oxidized starch, polyvinyl alcohol and styrene-butadiene copolymer latex (SBR latex) were prepared respectively.

The above coatings or coating solutions were coated on commercial coating paper each in a coating amount of 3–7 g/m$^2$ by using a wire bar and dried by a drier. For the coatings No. 1–No. 8, coated sheets were subjected to heat treatment at 150° for one min. to harden the coating films.

Separately, sublimable thermal transfer inks of blue, yellow and red were prepared by kneading 10 parts by weight of each of the following three sublimable disperse dyes; namely Disperse Blue 24 (marketed under the tradename of "Duranol Blue 2G"), Disperse Yellow 42 (marketed under the tradename of "Resolin Yellow GRL") and Disperse Red 1 (marketed under the tradename of "Celliton Scarlet B"), independently with 3 parts by weight of polyvinyl butyral and 45 parts by weight of isopropyl alcohol by means of a three-roll mixing mill. A tissue paper having a basis weight of 30 g/m$^2$ was solidly gravureprinted with these inds to obtain a transfer substrate. The printed surface of the transfer substrate was brought into contact with the coated surface of the above-described thermal dye-transfer type recording sheet and the assembly was pressed for 0.2 second to a thermal plate of 3 cm×3 cm maintained at 350° C. so that the back face of the transfer substrate was face to the thermal plate, whereby thermal transfer to the thermal recording sheet was performed.

The state of adhesion between the the thermal transfer substrates and the thermal dye transfer type recording sheets were observed just after the thermal transfer, and their heat-adhesion resistance was evaluated as below by the three steps of A–C, with A being the best.

A: The thermal transfer substrate did not adhere at all to the recording sheet.

B: The substrate detached from the thermal recording sheet by slightly snapping rearface thereof with fingers.

C: The substrate did not detached by merely snapping with fingers and was difficult to detach even by using a tweezers.

The reflective optical density of the recording sheets was measured by using a Macbeth densitometer for each reflective optical density of blue, yellow and red on the recording surface thermally transferred to the thermal dye-transfer type recording sheet. The reflective optical density was expressed as numerical values using each of a visual filter (Wratten No. 106) for blue color, a blue filter (Wratten No. 47) for yellow color and a green filter (Wratten No. 58) for red color.

TABLE 1

| Test results for Example | | | | | | | |
|---|---|---|---|---|---|---|---|
| Thermal dye-transfer type recording sheet | | | Recorded sheet | | | | |
| | | | Heat-adhesion | Reflective optical density | | | |
| No. | Type of the coated resin | | resistance | Blue | Red | Yellow | Total |
| Present invention | | | | | | | |
| 1 | Alkyd resin<br>Melamine resin | 75<br>25 | A | 1.82 | 1.96 | 0.83 | 4.61 |
| 2 | Alkyd resin<br>Melamine resin | 50<br>50 | A | 2.30 | 2.26 | 0.97 | 5.53 |
| 3 | Alkyd resin<br>Melamine resin | 25<br>75 | A | 1.89 | 2.12 | 0.85 | 4.86 |
| 4 | Alkyd resin<br>Urea-Melamine resin | 50<br>50<br>50 | A | 2.04 | 2.10 | 0.99 | 5.13 |
| 5 | Alkyd resin<br>Banzoguanamine resin | 50<br>50<br>50 | A | 2.11 | 2.21 | 1.03 | 5.35 |
| Reference example | | | | | | | |
| 6 | Alkyd resin | | B | 1.34 | 1.41 | 0.72 | 3.47 |
| 7 | Melamine resin | | A | 1.18 | 1.81 | 0.75 | 3.74 |
| 8 | Methylol melamine | | B | 1.35 | 1.56 | 0.92 | 3.83 |
| 9 | Oxidized starch | | A | 0.63 | 0.76 | 0.59 | 1.98 |
| 10 | Polyvinyl alcohol | | C | | (not peeled) | | |
| 11 | SBR latex | | C | | (not peeled) | | |
| 12 | Original | | A | 1.05 | 1.17 | 0.62 | 2.84 |

Note
High reflective optical density means good color density.

As apparent from Table 1, thermal dye-transfer type recording sheets Nos. 1–5 according to the present invention each provided with a coating layer comprising an aminoalkyd resin causes no heat adhesion at all between the recording sheet and the thermal transfer substrate and gives extremely high reflective optical density. On the other hand, the recording sheets Nos.

6–8 each provided with a coating layer composed singly of alkyd resin, amino resin (melamine resin) or methylol melamine, scarcely cause heat-adhesion, but shows only low reflective optical density. Further, the sheet No. 9 coated with oxidized starch shows an extremely low reflective optical density, and both of the sheets No. 10 and No. 11 coated with polyvinyl alcohol and SBR latex respectively cause heat adhesion, which makes it impossible to measure the reflective optical density.

The original sheet No. 12 provided with no coating layer was also tested and found only to provide low reflective optical density.

We claim:

1. Thermal dye-transfer type recording sheet having a coating layer, the coating layer being contacted with a coloring material layer containing sublimable dye on a substrate, the coloring material being selectively transferred on the coating layer by heating, wherein the coating layer comprises a mixture of an amino resin and an alkyd resin at a mixing ratio by weight of said amino resin to said alkyd resin in the range from 40:60 to 60:40.

2. Thermal dye-transfer type recording sheet according to claim 1, wherein the coating layer further comprises at least one pigment selected from the group consisting of natural ground calcium carbonate, precipitated calcium carbonate, kaolin, silica, talc, titanium dioxide, aluminium hydroxide, magnesium carbonate, barium sulfate and zinc oxide.

3. Thermal dye-transfer type recording sheet according to claim 1, wherein the coating layer is coated on the recording sheet at 4–15 $g/m^2$.

* * * * *